US008451189B1

(12) United States Patent
Fluhler

(10) Patent No.: US 8,451,189 B1
(45) Date of Patent: May 28, 2013

(54) ULTRA-WIDE BAND (UWB) ARTIFICIAL MAGNETIC CONDUCTOR (AMC) METAMATERIALS FOR ELECTRICALLY THIN ANTENNAS AND ARRAYS

(76) Inventor: Herbert U. Fluhler, Madison, AL (US)

( * ) Notice: Subject to any disclaimer, the term of this patent is extended or adjusted under 35 U.S.C. 154(b) by 516 days.

(21) Appl. No.: 12/761,278

(22) Filed: Apr. 15, 2010

Related U.S. Application Data

(60) Provisional application No. 61/212,698, filed on Apr. 15, 2009.

(51) Int. Cl.
*H01Q 15/02* (2006.01)

(52) U.S. Cl.
USPC ..... 343/909; 343/756; 343/795

(58) Field of Classification Search
USPC ..... 343/700 MS, 756, 795, 909
See application file for complete search history.

(56) References Cited

U.S. PATENT DOCUMENTS

| | | | | |
|---|---|---|---|---|
| 6,483,480 | B1 * | 11/2002 | Sievenpiper et al. | 343/909 |
| 6,525,695 | B2 * | 2/2003 | McKinzie, III | 343/756 |
| 6,897,831 | B2 * | 5/2005 | McKinzie et al. | 343/909 |
| 6,952,190 | B2 * | 10/2005 | Lynch et al. | 343/909 |
| 7,420,524 | B2 * | 9/2008 | Werner et al. | 343/909 |

* cited by examiner

*Primary Examiner* — Tho G Phan
(74) *Attorney, Agent, or Firm* — Mark Clodfelter

(57) ABSTRACT

This disclosure demonstrates a new class of Ultra-Wide Band (UWB) AMC with very large fractional bandwidth (>100%) even at lower frequencies (<1 GHz). This new UWB AMC is enabled by recognizing that any AMC must be an antenna in order to accept the incident radiation into the circuit. Therefore, by using UWB antenna design features, one can make wide band AMCs. Additionally, by manipulation of the UWB AMC element design, a 1/frequency dependence can be obtained for instantiating the benefits of a quarter wave reflection over a large UWB bandwidth with a single physical thickness.

50 Claims, 9 Drawing Sheets

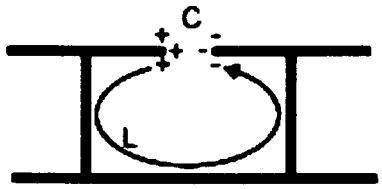
$$C = \frac{D\varepsilon_o(\varepsilon_r + 1)}{\pi} \ln\left(\frac{2D}{\pi g}\right)$$
FIG. 2A PRIOR ART
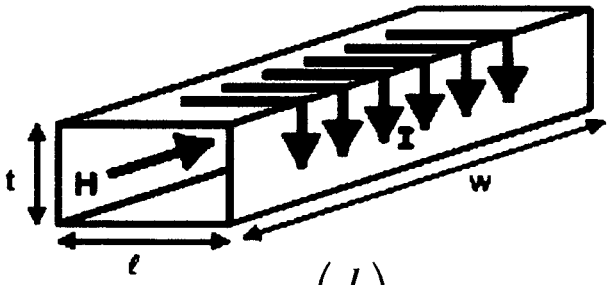
$$L = \mu t\left(\frac{l}{w}\right)$$
FIG. 2B PRIOR ART
$$BW = \frac{Z_0}{\eta} = \frac{\sqrt{L/C}}{\eta_0/\sqrt{\varepsilon_r}}$$
FIG. 2C PRIOR ART $$\Gamma_{rp}(\theta) = e^{j\phi_{rp}(\theta) = A(\theta) + B(\theta)f}$$

$$d_{rp}(\theta) = -cB(\theta) / 4\pi \cos(\theta)$$

$$\phi_{rp}(\theta) = A(\theta)$$

ULTRA-WIDE BAND (UWB) ARTIFICIAL MAGNETIC CONDUCTOR (AMC) METAMATERIALS FOR ELECTRICALLY THIN ANTENNAS AND ARRAYS

CROSS REFERENCE TO RELATED APPLICATIONS

This application claims the benefit of provisional application No. 61/212,698, filed Apr. 15, 2009, this provisional application being incorporated in its entirety herein by reference.

FEDERALLY SPONSORED RESEARCH

This invention was created partially with support from the United States Government, Department of Defense, U.S. Army, under Small Business Innovative Research (SBIR) program contract W911QX-08-C-0096. The United States has certain SBIR rights in the invention as described in the SBIR authorization statute.

FIELD OF THE INVENTION

This invention relates to a subset of Radio Frequency (RF) Metamaterials, specifically Artificial Magnetic Conductors (AMC) instantiated with Ultra-Wide Band (UWB) Artificial Dielectric Materials (ADM) for the purpose of enabling thinner wide band antennas and antenna arrays.

BACKGROUND OF THE INVENTION

Artificial Magnetic Conductors (AMC) are theoretical materials that reflect electromagnetic radiation with zero degree phase change as opposed to Perfect Electric Conductors (PEC) that reflects electromagnetic radiation with a 180 degree phase of reflection (polarity flip) as described in reference (1), which is hereby incorporated in its entirety herein by reference. A key benefit of AMCs is that antenna elements can be placed very close to the AMC surface without the surface shorting out the antenna element as is the case with PEC surfaces. This permits the instantiation of very thin antennas which is a very desirable trait for many antenna applications. Additionally, the AMC will reflect the back lobe pattern of the antenna into the forward direction with no phase inversion: i.e. in-phase and coherent with the front lobe. This produces a 3 dB increase in gain without narrowing the beam (i.e. without changing the Directivity) as the energy that would have gone out the back direction is redirected in phase and with the same pattern as the energy directed in the forward direction.

A central limitation of all AMCs demonstrated to date is narrow fractional bandwidth (typically less than 10% and often less than a couple of percent bandwidth), and a progressive difficulty in achieving any practical useful bandwidth at lower frequencies (a couple of GHz or lower). For those applications that only require a narrow band, or a tuned narrow band, the traditional AMC solutions are adequate. However, many applications and progressively newer applications require wider bands and more bands, effectively requiring Ultra-Wide Band (UWB) performance. By producing a new AMC that has Ultra-Wide Band (UWB) response (defined by DARPA as a fractional bandwidth greater than 25%) a UWB antenna can then be placed in front of and almost in contact with the AMC. The expected result is the instantiation of a true UWB very thin conformal antenna and associated arrays. Anticipated Benefits/Potential Commercial Applications of the proposed design are much thinner antennas and arrays that also cover a UWB bandwidth. This can result in a fewer number of antennas needed in a given application and the ability to build the antenna conformally on or into any surface because of the improved thinness.

Common physical instantiations that manifest AMCs-like properties include Sievenpiper's AMC patches as described in references (2, 3, 4, 5), which are incorporated in their entirety herein by reference, corrugated surfaces and a simple quarter wave standoff between the antenna element and a PEC backplane. The conventional theory of operation of AMCs is discussed in the above-cited references. The key-enabling ingredient in AMC operation is changing the reflection boundary condition. Changing the reflection boundary condition from the PEC boundary condition to a new boundary condition of intentional design produces the desired zero phase reflection response behavior. This phenomenon does not generally happen in naturally occurring materials, and so the required approach must invoke the use of the new field of Metamaterials (1).

Sievenpiper AMCs traditionally are composed of square or hexagonal mushroom-like structures on thin Printed Circuit Board (PCB) substrates. There is usually an implicit, if not always acknowledged antenna like response inherent in their operation. That is, an incident field is presumed to be sufficiently impedance matched to the AMC, such that the electromagnetic wave can be absorbed into the AMC structure. Once the electromagnetic wave has been converted to current in the AMC circuit, the AMC circuit can operate as intended to produce a return with zero net phase. However, as one moves off the resonant frequency of these traditional AMC structures, the AMC system is no longer tuned to receive the incident electromagnetic field. It is perhaps simplistic but easy to illustrate that since many AMC structures resemble and have operational similarities to microstrip patch antennas, that since patch antennas are narrow band, so too must be these AMC structures. Hence its really their antenna receiving properties, and not the underlying AMC circuitry that limits the bandwidth of AMCs. The AMC must convert the incident radiation into current before any AMC behavior can be subsequently produced.

This antenna-like response is at least slightly different than that ascribed to it in the conventional AMC theory, and as one modifies the mushroom shape, the specifics of its response to an incident electromagnetic wave takes on specific behavior that can only be modeled in true electromagnetic wave simulation codes, thereby confirming that the antenna performance aspects of the AMC design limit its bandwidth. If one tries only to modify the AMC circuit for larger AMC bandwidth, this results in larger inductance in the AMC circuit which then results in a larger impedance mismatch with the incident electromagnetic wave, thereby preventing its coupling into the AMC circuit. In effect, the Sievenpiper theory breaks down with significant deviations from the normal design, and the specifics of the implementation begin to matter more and more with such deviations.

For example, in the extreme where the AMC patch is replaced with a wire and large discrete inductors (in order to maximize bandwidth according to the conventional theory), the electromagnetic wave may not couple to the circuit hardly at all, thereby "blowing by" the AMC circuit and hence negating any possible AMC effect. Excessively large inductors can have a similar effect by electrically breaking the AMC circuit at higher frequencies, and excessively large capacitors have the opposite effect, negating effective AMC behavior at lower frequencies. The issue then is that the theory claims such reactance extremes are needed to achieve wide bandwidth operation, but such extremes of capacitance and inductance decouple the AMC circuit from the incident electromagnetic wave, so no net AMC behavior is obtained under these wider band conditions.

The summation of these observations is the somewhat unacknowledged requirement that any AMC must first act enough like an antenna so that it captures the electromagnetic energy from the electromagnetic wave of interest. Only after the electromagnetic energy capture can the resulting current be modified inside the AMC circuit. If this conversion does not happen, then there is no current in the AMC circuit, and the capacitance and the inductance of the AMC circuit can have none of its intended effect to produce a zero phase AMC reflector. At the most fundamental level, this is what prevents the realization of a wide band or UWB AMC.

SUMMARY OF THE INVENTION

Based on the insights in the prior section, the core aspect of this invention is that an AMC must be an antenna, and by corollary a UWB AMC must also be a UWB antenna. Conversely, it is also possible, but not given, that a suitably designed antenna might be made an AMC. With this premise, a patterned planar array of capacitively coupled UWB planar elements is conceived as a possible AMC structure. Note that there is no explicit requirement that this AMC be strictly planar (although that is the simplest to design and simulate), and multilayer (3-dimensional) embodiments are included in the possible design alternatives.

There are two parts to the operation of the present invention. The first part is the aspect of producing a zero phase or near zero phase reflection from the UWB antenna elements in our patterned AMC array, and the second part is the net phase response of this array and its exploitation with a PEC backplane to produce a net AMC behavior.

With respect to the first part of the operation, we create a planar array of dual polarized UWB antenna elements. Single polarized UWB elements might be used if only a single polarization were of interest. But in the general case, dual polarization is the superset embodiment that we describe with the single polarized case being an obvious degenerate case to one skilled in the art.

With a traditional array of antenna elements, narrow band or UWB, one would usually connect a feed line to the feed of each antenna element. Nominally the feed line would have a characteristic impedance equal to the feed impedance in order to maximize the received power transfer into or out of the feed line, and minimize reflection of power from the feed due to any impedance mismatch. In our case, we actually want the feed to reflect the received power so that it reradiates back out of the antenna elements. However, we want that reflection to occur with a specific phase, and ideally that phase is near zero degrees of phase. So, instead of placing a matched port at the feed point of the each UWB antenna element in our new AMC array, an explicit open circuit is left in the design. Hence the operational concept is that the UWB antenna elements receive the energy from the wave, it gets converted to a current, and then that current moves to the feed points. But instead of encountering a matched load, the currents encounter an open feed point, which reflects the power back with a zero phase reflection angle just like an open microstrip stub, since an open RF circuit produces a zero phase change as opposed to a short circuit which would produce a 180 degree phase change. This radiation is then reradiated back out the array structure with a phase substantially closer to zero phase than not.

With respect to the second part of the operation of our new AMC invention, it must be recognized that an array of closely spaced antenna elements (narrow band or UWB) will exhibit mutual coupling between the elements. This mutual coupling produces a coupled dipole array type of structure that changes the behavior somewhat, particularly toward lower frequencies (the coupling producing a effectively larger antennas structure). The coupling can be complex to model analytically and therefore electromagnetic simulation codes such as Finite Difference Time Domain (FDTD) and other simulation methods are preferred methods to compute exact behavior in such cases. However, by simplifying the physical model, further insight is obtained. Specifically, the simplest model of these UWB elements is as patches of metal with some wide band resonance that capacitively couples across the array. This configuration, and further configurations achieved by stacking multiple layers of such arrays atop one another, resemble the planar layers of Artificial Dielectric Materials (ADM). An ADM is one or more layers of closely spaced metallic patches, usually disks. The capacitance between the patches induces an artificial dielectric constant. ADMs have been known for a very long time, and have been used to create large RF lenses for low frequency radars. Within a defined band, the ADM material acts just like a real world dielectric material, possessing a dielectric constant Er and manifesting the expected 1/sqrt(Er) fractional slow down of the speed of light in the medium. This slow down of the speed of light produces an electrically longer propagation distance, and as will be seen this is of great interest. Alternatively, this longer electrical propagation distance can be viewed as a temporal delay line. If this delay is combined with the reflection phase off the open feed of the elements in the AMC array, this new structure is seen to have extra phase shifting or time delay properties beyond those of conventional ADMs or other possible materials. With sufficient delay, a phase of reflection can be rotated all the way around 2 pi radians such that the propagated and incident radiation appeared in phase. Hence, a short propagation distance from an AMC layer close to a PEC reflector and back can be made to appear electrically like a much longer path length that wraps a full cycle in a physical distance much shorter than a wavelength. This arrangement then behaves like an AMC and it manifests this behavior over a substantial bandwidth of about 100% or more.

BRIEF DESCRIPTION OF THE DRAWINGS

FIG. 2A shows the Capacitance and Current in a Sievenpiper AMC Cell.

FIG. 2B shows the Inductance and Current in a Sievenpiper AMC Cell.

FIG. 2C shows the equation for the Sievenpiper AMC Bandwidth.

DESCRIPTION OF PREFERRED EMBODIMENTS

Figure 1A:
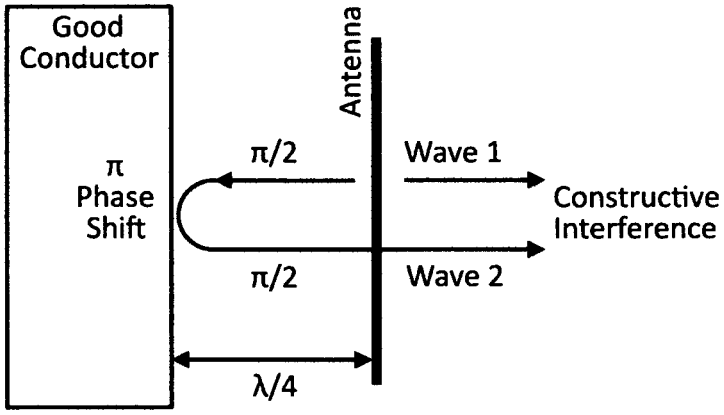
FIG. 1A PRIOR ART
FIG. 1A shows a traditional Quarter Wave Standoff Reflector for an antenna or array with a Perfect Electrical Conductor (PEC) backplane.

FIG. 1A shows a traditional quarter wave standoff of an actively fed antenna or thin array above a PEC backplane. The backward traveling wave 2 propagates a quarter wavelength (90 degrees) to the left, reflects from the PEC backplane with a 180 degree (pi radians) phase shift, then travels back to the antenna to meet up with a forward traveling (to the right) direct path wave emanating from the antenna. Because of the resulting 360 phase shift on the previously backward traveling, now reflected wave 2, it is in phase with the direct path wave 1 emanating from the antenna so that both now travel in phase to the right. This results in them adding constructively providing a doubling of the amplitude and a resulting quadrupling (6 dB) of the power/gain on boresight (i.e. directly to the right in the figure). If one were to observe the gain at angles off boresight, one would see lower relative gain off boresight versus an antenna without a backplane. This is because of the difference in path traveled of the reflected wave 2 for an observation point off axis as described in reference (6) which is incorporated in its entirety herein by reference.

Figure 1B:
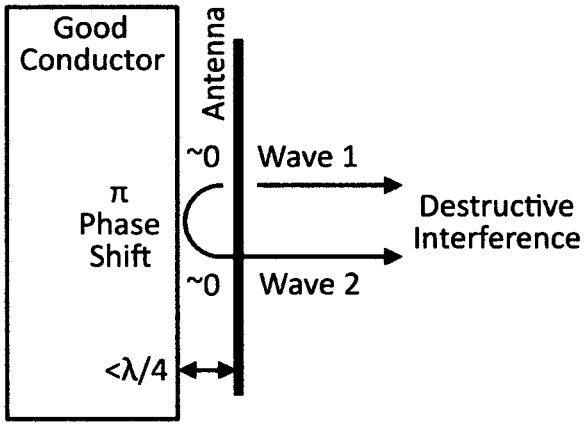
FIG. 1B PRIOR ART
FIG. 1B shows the reflection of a backwards propagating wave when an antenna or array is brought very close to a PEC backplane.

Invariably, many applications seek very thin antennas in order to minimize protrusions from host platforms and to meet desirable conformal mounting requirements. FIG. 1B illustrates the physical processes involved if one naively tries to produce a thinner antenna or array by reducing the distance to the PEC backplane from that illustrated in FIG. 1A. The path traveled by the backward traveling wave 2 is shortened considerably thereby changing it to something less than the 360 degrees illustrated in FIG. 1A that provided the desirable benefits of constructive interference. In fact, if the standoff distance from the antenna or array to the PEC backplane is reduced to zero, then the reflected wave 2 will be 180 degrees out of phase with the forward traveling wave 1, resulting in complete destructive interference. This manifests as a large Voltage Standing Wave Ratio (VSWR) or equivalently a Return Loss (RL) or equivalently a reflection Scattering Parameter (S11) that is very large (VSWR=infinity, RL=infinity dB, S11=0 dB). Obviously this is not a useful antenna or array, as none of the power can be radiated, and by reciprocity no power can be received either with such an antenna or array.

Figure 1C:
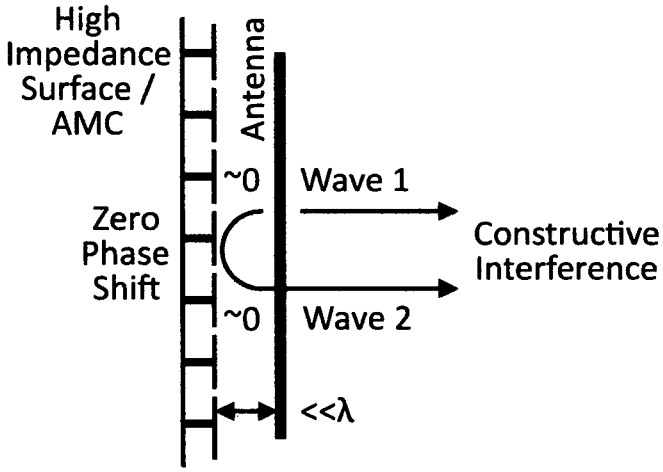
FIG. 1C PRIOR ART
FIG. 1C shows a Sievenpiper AMC For making a thin antenna.

FIG. 1C shows the application of an Sievenpiper "Mushroom Patches" type Artificial Magnetic Conductor (AMC) as described in references (1, 2). Since the AMC reflects travelling wave 2 backward with a zero degree phase, placing the antenna or array directly almost in contact with the AMC is the geometry which produces constructive interference. Of course this also provides for the thinnest antenna, the thickness now being constrained only by the thickness of the AMC and the materials used to construct the nominally thin active feed antenna or array.

FIG. 2A illustrated a cross section through a unit cell of a metallic mushroom AMC (2). It also shows the current (circular arrow) inside the unit cell and the capacitance C that develops across the gap in the metallic AMC patches. The capacitance is a function of the size D of the patch, the gap g, and the dielectric constant Er of the substrate material used to host the AMC metallic structures. It also shows that this current experiences an inductive load L in traveling through the loop of the unit cell. FIG. 2B shows a similar cross section specifically to compute the inductance L. The inductance is a function of the thickness t, and the length l and width w of the unit cell. FIG. 2C shows the derived bandwidth for such the AMC structure as illustrated in FIGS. 2A and 2B. The key observation is that the bandwidth increases as the square root of the inductance L, inversely as the square root of the capacitance C, inversely as the impedance of free space Eta zero, and proportional to the square root of the dielectric constant of the substrate Er.

Unfortunately if one tries to make an AMC with very large bandwidth, that is, one that has large L, small C and large Er, then the AMC behavior will be lost. The large L opens up the circuit electrically for high frequencies since the inductive reactance of a large inductance is high at high frequencies. Likewise, a small capacitance C opens up the circuit at low frequencies since the capacitive reactance at low frequencies is large. A large Er serves to further exacerbate the capacitance by increasing it when it is desired to be smaller, and it also changes the impedance of the AMC structure thereby presenting an impedance discontinuity to an incident wave with the impedance of free space, 377 ohms. The incident wave is then reflected from the AMC without ever interacting with the unit cell circuit. In effect, under the wide band design criteria of FIG. 2C, either the top metal patches of the AMC patches reflect the incident wave, or the wave just passes through the AMC unit cell without interacting with it, directly to the PEC backplane, from which it then reflects with a 180 degree phase inversion, exactly the undesired behavior.

The key observation from these analyses is that an incident wave MUST be converted into a current inside the AMC circuit or else there can be no AMC effect. The incident wave must be converted into a current in the AMC circuit, then the AMC circuit needs to operate on this current to change its phase, and then the phase changed current needs to be converted back to a reradiated wave that then has the desired zero phase property. And this process should ideally be performed with no loss of power. Only using the equation of FIG. 2C with a traditional AMC structure only works over a very narrow band. This is because the fundamental elements of traditional AMCs are narrow band patch structures much like microstrip patch antennas. These structures have poor bandwidth characteristics for receiving an incident electromagnetic wave, and thereby limit the bandwidth of the AMC in contradiction to the equation of FIG. 2C. The conclusion drawn from these observations is that the AMC element of the unit cell, must be an antenna with a bandwidth desired, or else no AMC action is possible regardless of the underlying circuit properties.

The core concept of this invention then is that if one desires a wide band AMC, one must use unit cell elements that exhibit antenna properties with desirable antenna characteristics over the band of interest. Further, if one desires UWB type bandwidth, then one must use UWB antenna designs as the basis for constructing AMC unit cell structures. There are myriad antennas, both planar and non-planar, both wide band and UWB, that could be used for this purpose depending on the specific application requirements. Many of the more prominent UWB antenna elements which are immediate candidates for a UWB AMC are illustrated and described in (7) which is incorporated in its entirety herein by reference.

A quintessential UWB antenna is the well known "Bowtie" UWB dipole. Many other UWB antennas are known (7), such as elliptic and circular dipoles and tapered slots to name just two other of the best performing alternatives. Any of these could be used as alternatives for the Bowtie illustrated herein, differing only in the specifics of their performance and the preference of their specific characteristic differences for a specific application. The Bowtie UWB dipole will therefore serve as an illustrative example of how to employ any of them in a UWB AMC design.

Figure 3A:
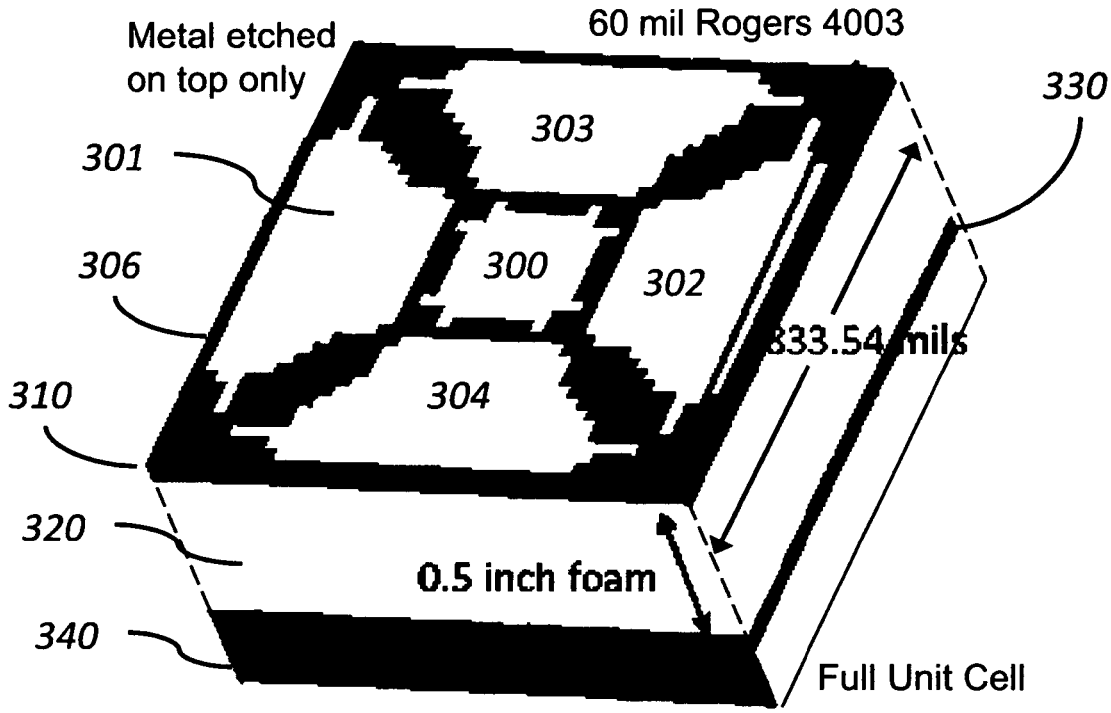
FIG. 3A shows the Unit Cell for the exemplary new "Iron Cross" UWB AMC.

FIG. 3A shows an exemplary UWB AMC unit cell based on the Bowtie UWB dipole. The unit cell is comprised of a top Printed Circuit Board (PCB) 310, a low dielectric spacer (nominally air or foam) 320, and a backplane PCB 330 with PEC conductive cladding only on its backside 340, i.e. the side away from foam or space 320. The front PCB 310 has no cladding on its backside (adjacent to the space or foam 320) but does have etched metallic patches 300, 301, 302, 303, 304 on its front surface. All the PCBs in this design are made from Rogers Corp laminate 4003C with one ounce copper cladding, although other PCB alternatives, or even other methods of instantiating the design other than PCBs may be used if done properly by one expert in the art of RF microwave electronics and antennas.

On circuit board 310, patch 300 acts like a ground reference for the unit cell. However, its prime purpose is to help shape the high frequency behavior of the UWB AMC. As such, it may be omitted if higher frequency performance is desired. Alternatively, it may be connected to the backplane conductor 340 with a conductive via similar to the way that traditional mushroom AMC patches are attached to the backplane conductor. This via conductor has no effect for incident boresight radiation because the currents on either side of the via are balanced for boresight incident radiation thereby resulting in zero net current on the via and hence no need for it. However, the via can serve to suppress surface waves when radiation is incident from directions off boresight to the UWB AMC.

Patch 300 is capacitively coupled to patches 301, 302, 303, and 304. Patch 301 through patch 300 to patch 302 form a UWB Bowtie-like dipole in the horizontal polarization plane. Patch 303 through patch 300 to patch 304 form a UWB Bowtie-like dipole in the vertical polarization plane. Hence this design is dual polarization capable.

Each orthogonal dipole (301 with 302, and 303 with 304) has an effective feed impedance defined by the capacitive coupling with patch 300. Although patch 300 is a short, its interfaces to patches 301, 302, 303 and 304 are opens. Therefore, the feed impedances of the orthogonal dipoles is substantially that of an open, although it is "tuned" by the size of patch 300 and the width of the gap between 300 and the other top surface patches 301, 302, 303 and 304. If patch 300 is omitted, then additional high frequency bandwidth is enabled, but the phase may or may not be optimum when accounting for the propagation delay of the induced currents along the patch lengths. Therefore, patch 300 is an optional element depending on the specifics of the design, and its omission likely increases bandwidth in most cases but at the possible expense of some phase control on the reflected signal.

Although all the patches 301, 302, 303 and 304 are Bowtie-like, they do have some detailed shaping that optimizes the design in the band of interest. This applies also to patch 300. Additionally, there is a gap 306 of separation between the outer edges of the patches and their corresponding neighbor edges in adjacent unit cells of an array of such unit cells. These gaps have a capacitance between them that couples the entire array together. This has the effect of changing the frequency response of the unit cells from that of a strict Bowtie dipole. It also has the effect of introducing an effective Artificial Dielectric Material Constant (ADM) property to the AMC. The impact of this ADM behavior will be described shortly. The specific net AMC response is dependent on the details of the gaps 306 and their contours, as well as the gaps and contours of the other patches 300, 301, 302, 303, and 304.

The specifics of these contours and those of the other patches is determined by an optimizer (e.g. Genetic Algorithm) connected to an electromagnetic (E&M) simulation program using one or more of the standard techniques such as Finite Difference Time Domain (FDTD), Finite Element Analysis (FEA) or Moment of Methods (MoM) among possible others well known those trained in the art of antenna modeling. The optimizer adds or subtracts metallization in small chips to or from the patch contours until certain user defined objectives of performance are achieved specific to the application requirements.

Figure 3B:
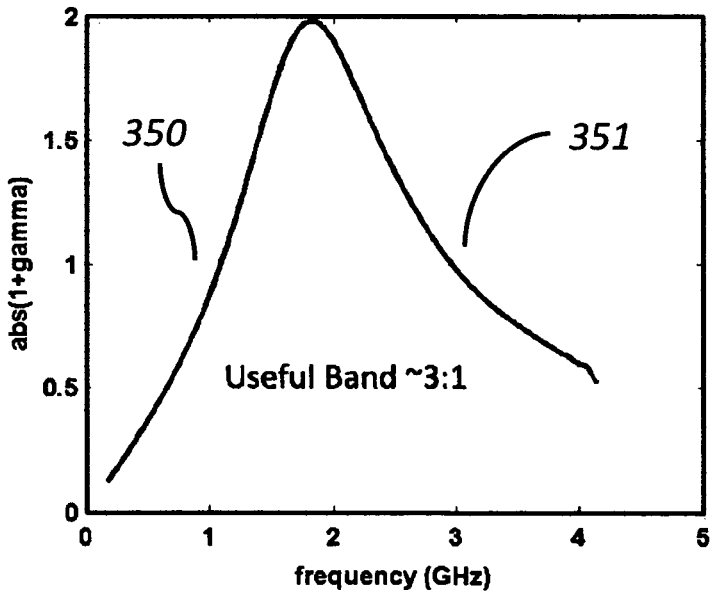
FIG. 3B shows the reflection (hence phase) performance for the exemplary new "Iron Cross" UWB AMC.

In general we are trying to achieve a net zero phase across a wide bandwidth without loss of power. This can be measured with a metric such as abs(1+gamma) as shown in FIG. 3B. With gamma as the reflection coefficient of the AMC obtained from the E&M simulator, a value of 2 infers complete in phase reflection, a value of 1 infers a 90 degree phase shift upon reflection and a value of 0 infers a 180 degree phase shift upon reflection. The useful phase regime for antenna performance with an AMC is +/−90 degrees, one extreme of which happens at the low frequency side of the performance band at 350 and the other of which occurs at the high frequency side of the performance band at 351. By optimizing to this or a similar metric and having the optimizer try to spread the frequency separation of 350 and 351, the optimizer can design a good UWB AMC from the core initial approximate design, as shown in FIG. 3A.

Figure 4A:
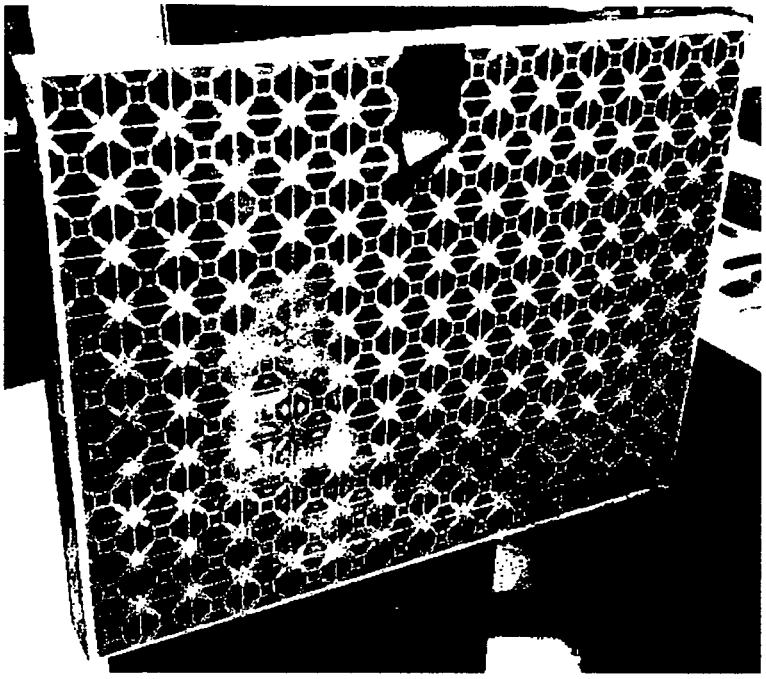
FIG. 4A shows a prototype panel of the "Iron Cross" UWB AMC under test.
Figure 4B:
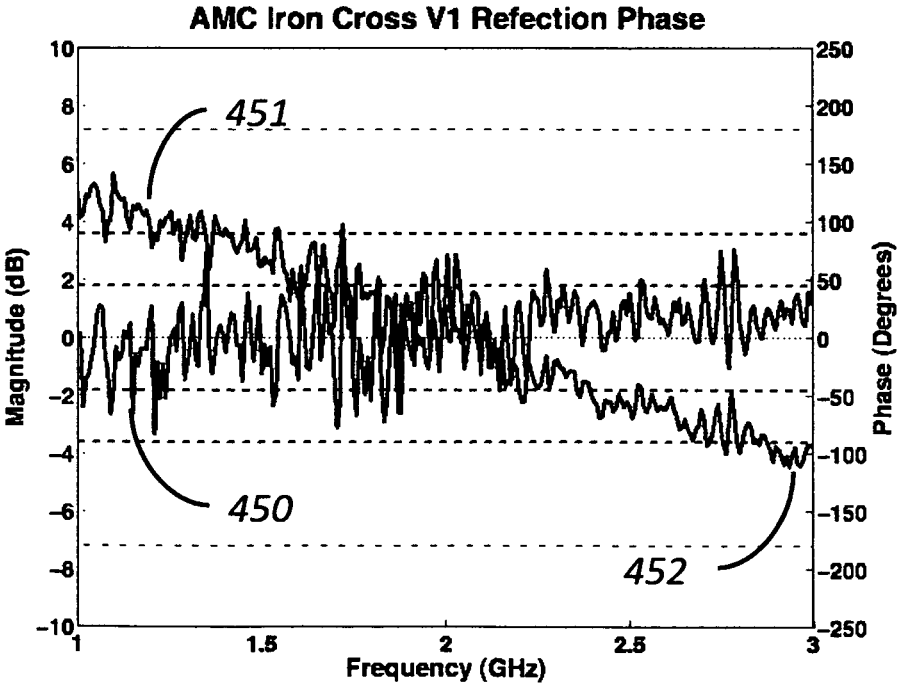
FIG. 4B shows the reflection magnitude & phase performance "Iron Cross" UWB AMC.

FIG. 4A shows a 12" square panel array of the UWB AMC unit cells in FIG. 3A. FIG. 4B shows a graph of the measured AMC response of this panel. The reflection magnitude 450 in dBs has its axis on the left of the graph. It is seen that the reflection magnitude remains near 0 dB indicating that almost all of the power is being reflected back to the illuminating antenna. The phase response has its axis on the right side of the graph. The lower frequency bound of good (+90 degree) performance is near 1 GHz at 451. The upper frequency bound of good (−90 degree) performance is near 3 GHz at 3 GHz. Therefore this AMC panel exhibits good AMC performance over an unprecedented 100% of bandwidth centered on a low frequency of 2 GHz.

Figure 5A:
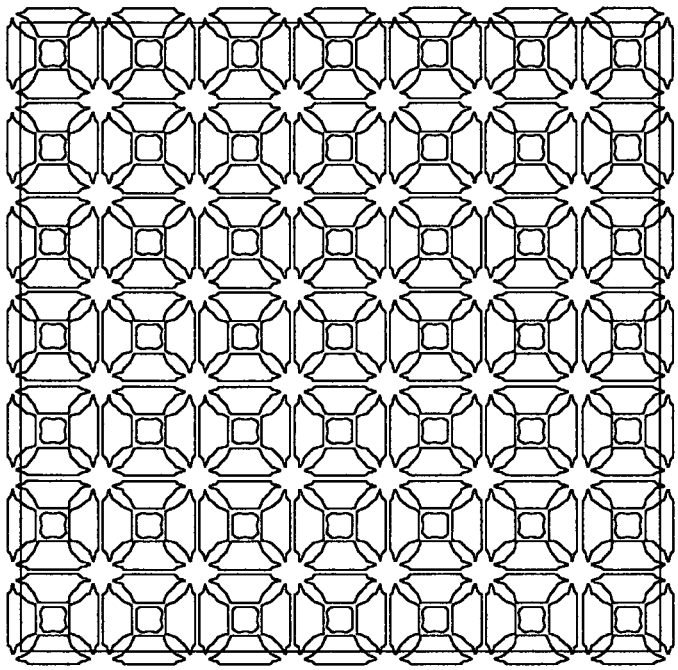
FIG. 5A shows a front view of "Iron Cross" UWB AMC ~16" Square Panel with 2.4" square unit cells to lower the response frequency down.

FIG. 5A shows a scaled version panel of the same basic design as shown in FIG. 3A except that the unit cell size has been scaled by a factor of 3 from 0.8 inches to 2.4 inches. The thickness of the spacer or foam has also been scaled by the same factor from 0.5 inches to 1.5 inches thickness. Nominally the PCB board thicknesses should also be scaled. This panel is a little over 16 inches square. Due to the scale size change, its performance should scale down in frequency with the zero phase reflection point occurring at about 666 MHz as opposed to the 2 GHz of the FIG. 3A design. This is of interest for lowering the cutoff frequency of antennas without making them thicker.

As mentioned earlier, the capacitive coupling between the unit cell petals has the effect of creating an Artificial Dielectric Material (ADM). ADM theory is well known and is covered in references (8) and its subordinate references which are incorporated in their entirety herein by reference. The ADM requires petals of metal that are much smaller than a wavelength. In this regime they are substantially broadband, but the transition to a shorter wavelength is less well described. In this mode of operation, the ADM effect will serve to add a propagation delay with its effective dielectric constant. The effect is substantially a similar delay to that shown in FIG. 1A, but with a much shorter physical thickness than shown in FIG. 1A.

Figure 5B:
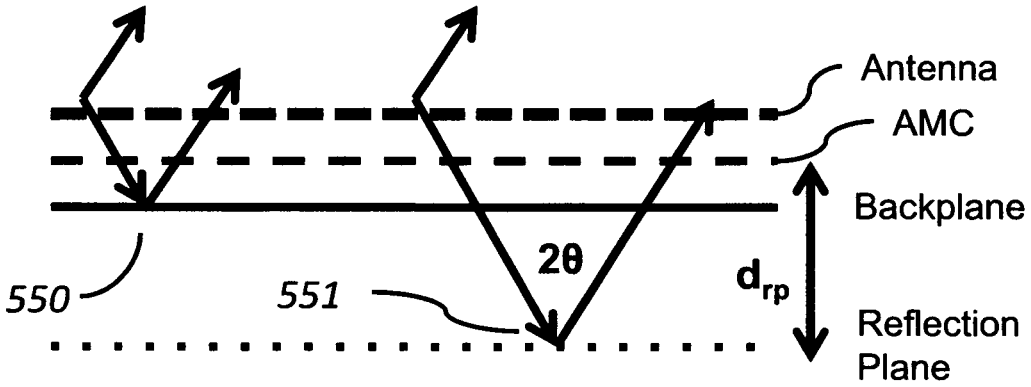
FIG. 5B shows the geometry and equations for the Reflection Plane Depth & Reflection Phase for the effective reflection offset created by the AMC layer.

To explore the effect of this ADM, we use the method of Maloney et. al. (9) which is incorporated in its entirety herein by reference to measure the depth of the effective reflection plane and its associated reflection phase. FIG. 5B shows the geometry of the phenomena of interest. A normal reflection off the PEC backplane without AMC of the backward moving wave is shown at 550. With the AMC, the effective reflection plane is moved deeper and behind the physical backplane as shown at 551. The effective plane of reflection is then displaced by an apparent additional distance $d_{rp}$ as shown in the figure. The equations for the complex reflection gamma and the distance and phase of the reflection are also shown.

Figure 5C:
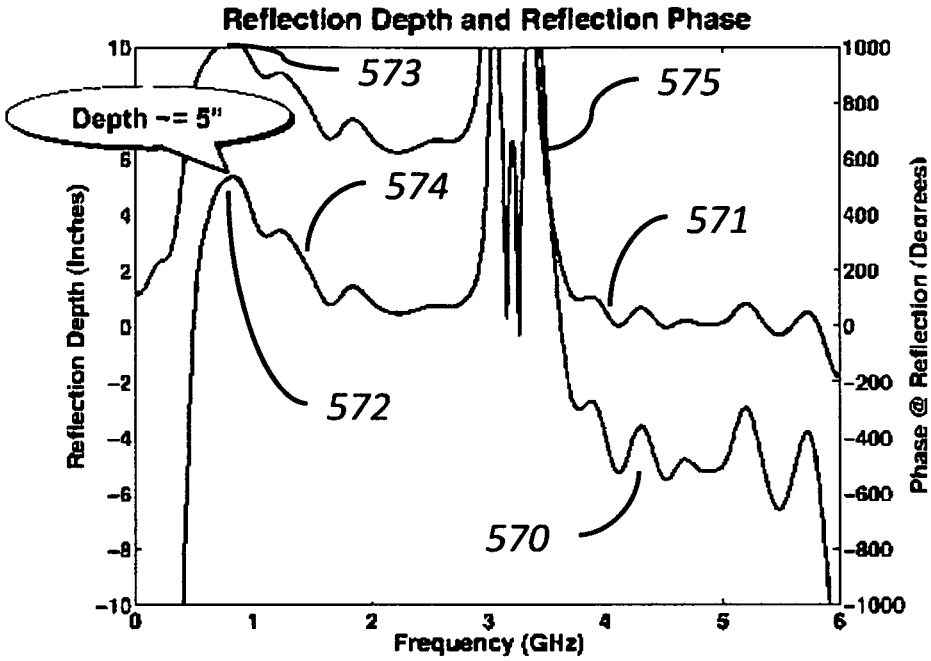
FIG. 5C shows the measured Reflection Plane Depth & Phase of the "Iron Cross" UWB AMC with 2.4" square unit cells.

FIG. 5C shows the processed measurements of reflection plane depth and phase of the UWB AMC of FIG. 5A. The reflection plane depth 570 has its axis on the left side of the graph. The reflection plane phase 571 has its axis on the right side of the graph. The deepest reflection plane depth is shown at about 5 inches near 572. This is considerably deeper than the 1.5 inch physical depth of the air/foam spacer 320, showing the desired effect of making the antenna or array look electrically deeper than it is physically. At that same frequency, the phase 573 is about 1080 degrees which is an integral multiple of 360 degrees to provide the expected zero phase response at 666 MHz. The shape of the depth curve at 574 is also very important, because through computer optimization, this curve can be made to exhibit an inverse frequency dependence over a substantial bandwidth. What this will do is to maintain the reflection plane distance at exactly a quarter wavelength across a very wide band around 574, thereby achieving wider bandwidth operation of the UWB AMC. There is a resonance at 575 which is the half wavelength null corresponding to the AMC spacer distance of 320.

Figure 6A:
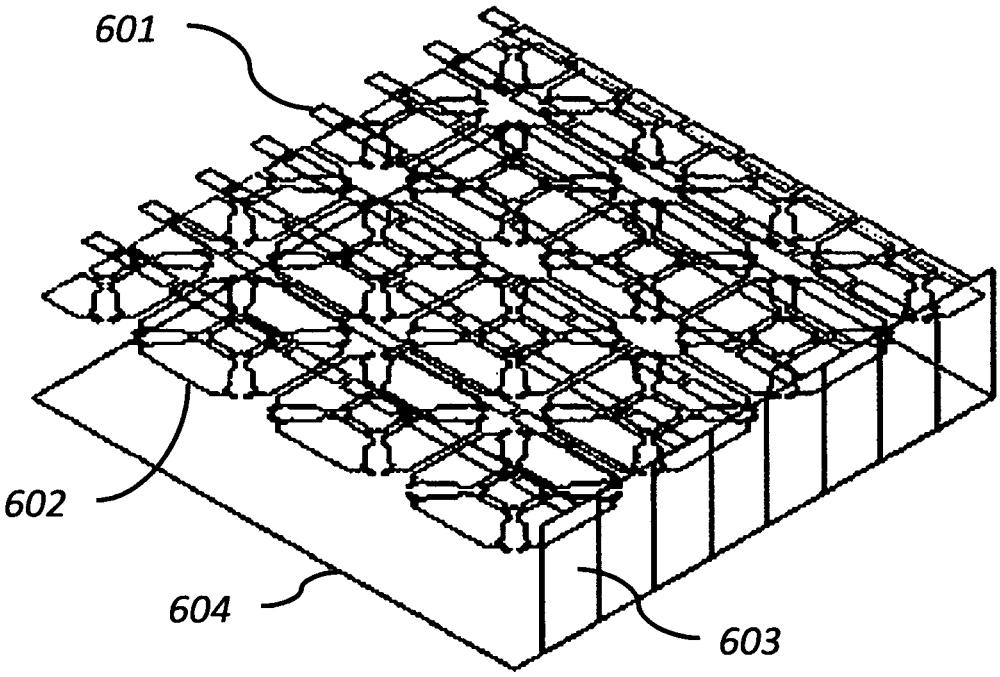
FIG. 6A shows a computer simulation model for the 2.4" unit cell "Iron Cross" UWB AMC integrated with a simple strip element Connected Array in front of it and with resistive termination at the ends of the strings of strip elements.

This same UWB AMC of FIGS. 5A, 5B and 5C were entered into a FEA electromagnetic simulator, Agilent's EMDS, and run with an overlaid fed array for the design frequency of 666 MHz and the modeling configuration shown in FIG. 6A. A simple connected array consisting of 1" long by 0.25 inch wide metal strips 601 was overlaid a quarter inch over the UWB AMC layer 602 suspended 1.5 inches above a PEC backplane 604. Strips of resistive termination 603 were added to connect the edge connected array petals 601 to the PEC backplane 604 in order to terminate the end currents to improve overall VSWR/S11 performance.

Figure 6B:
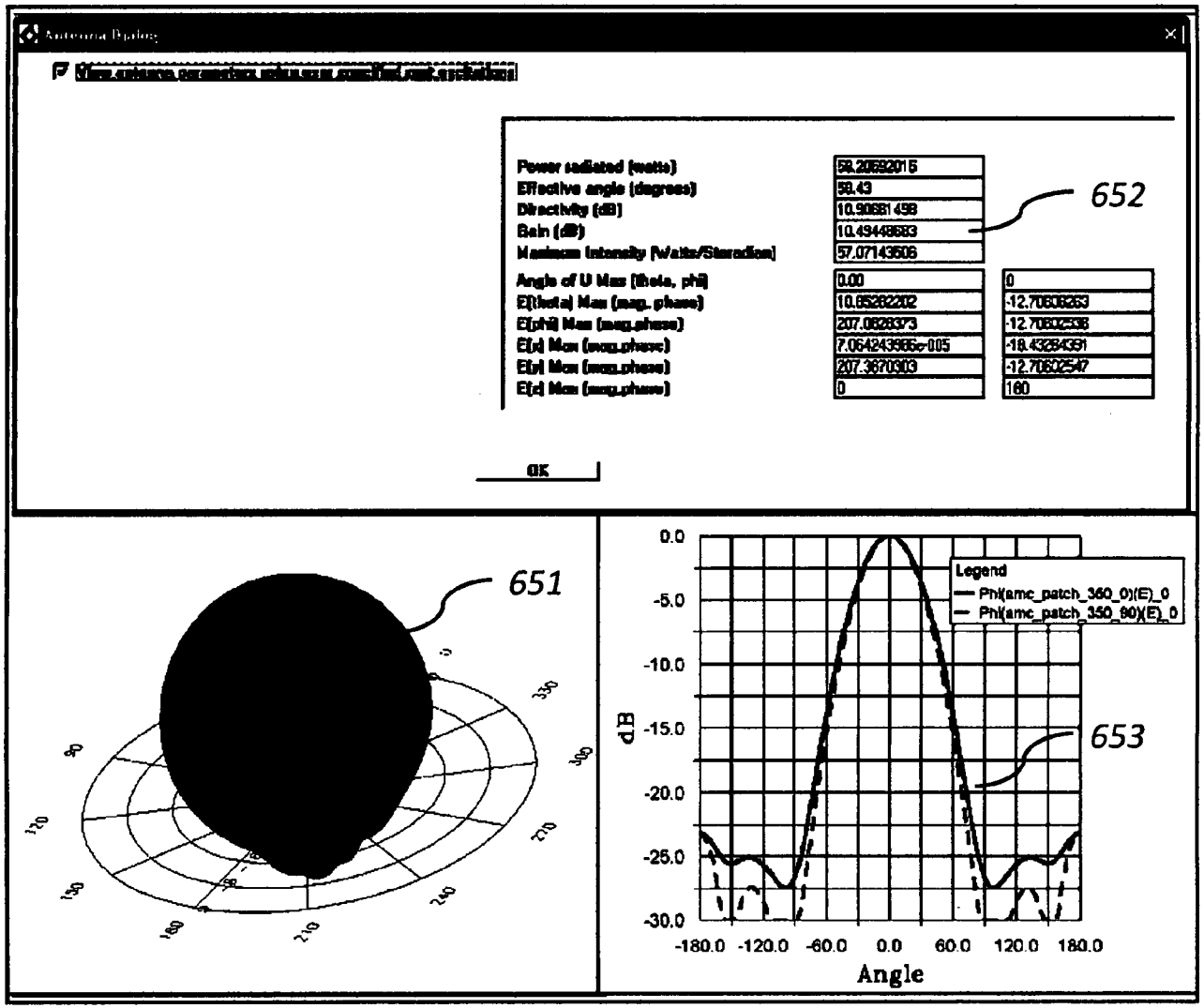
FIG. 6B shows the excellent Array Beam, Pattern & Gain of the "Iron Cross" UWB AMC with 2.4" unit cells.

The results of this simulation are given in FIG. 6B and showed very good performance versus the performance without the AMC. The antenna pattern was a very nice singular beam 651 with very good beam pattern 653 and low sidelobes. Furthermore, the gain 652 was very close to the directivity, thereby indicating high efficiency. Such efficiency could not have been achieved with a high return loss thereby substantiating the benefits of the UWB AMC.

Figure 7:
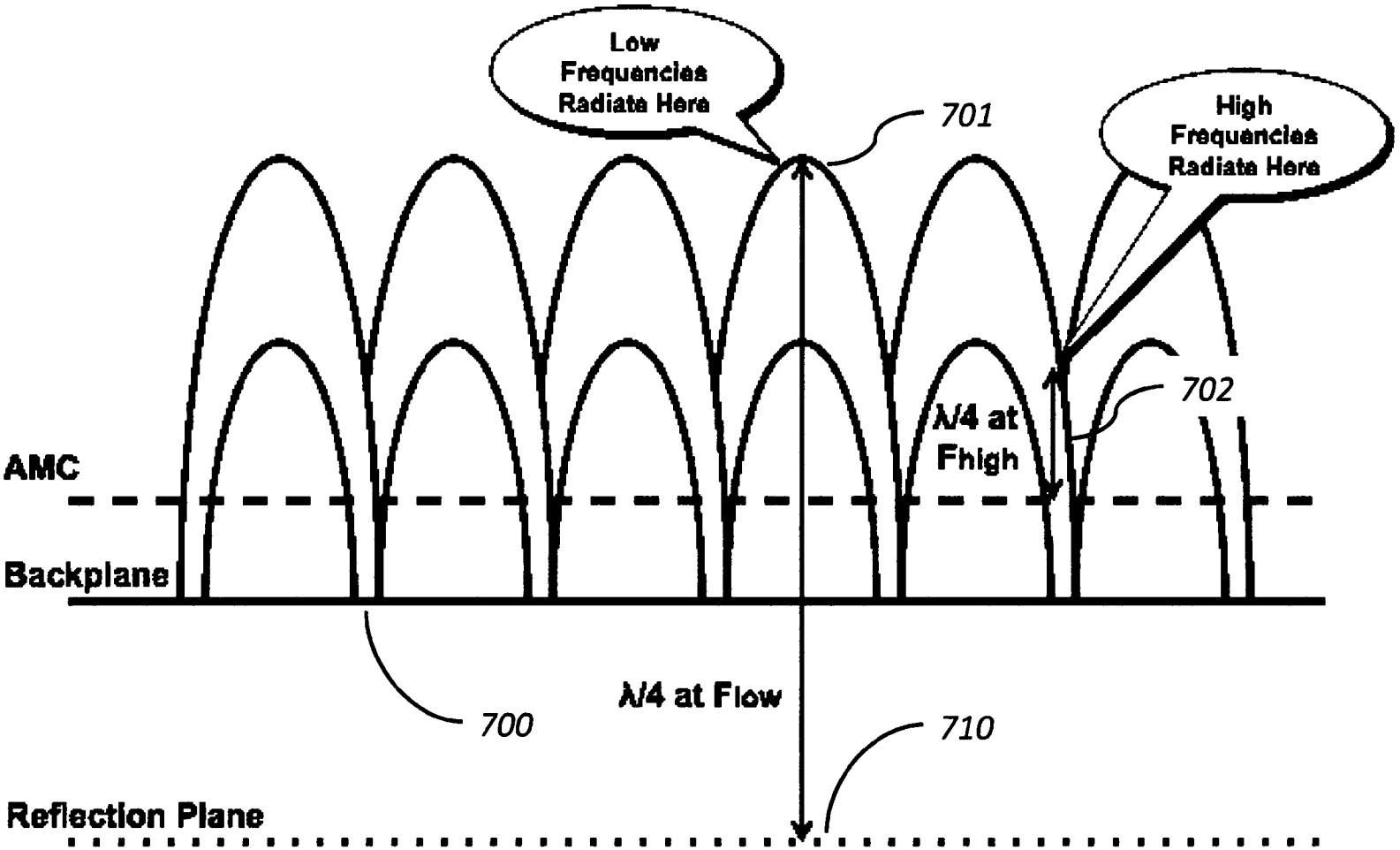
FIG. 7 shows the application of the UWB AMC to a Connected Vivaldi Slot Array.

FIG. 7 shows how this UWB AMC may be applied to lower the low frequency cutoff of a Vivaldi Slot connected array. Differential excitations are disposed at the overlap of the slot feed strips at 700 to produce a connected array of such Vivaldi petals. When excited, the array will preferentially radiate low frequency radiation 701 from the tips of the petals, and high frequency radiation 702 from the throat. The high frequency radiation radiated from deep in the throat of the Vivaldi slot will have some forward radiating gain. Therefore, its proximity to a PEV backplane 710 is of less or little importance. However, the lower frequency radiation 701 emitted from the tips of the pedals is much more omnidirectional and will certainly reflect off the PEC backplane 710.

The integration of the AMC into this design includes passing the feed strips through the AMC and positioning the AMC and sizing the AMC for optimal performance with the E&M optimizer codes described earlier. The optimizer will be programmed to try to size the AMC such that it produces a reflection plane 710 that is a quarter wavelength at the desired low frequency of operation of the antenna, and such that it presents a substantially PEC response at the high frequency of operation and spaced such that 702 is about a quarter wavelength above the AMC. This latter point is less critical than the getting the reflection plane 710 where needed since the higher frequencies will be radiated with at least some preferential gain in the forward direction with a lesser concern for the lower power backward flowing radiation.

Figure 8A:
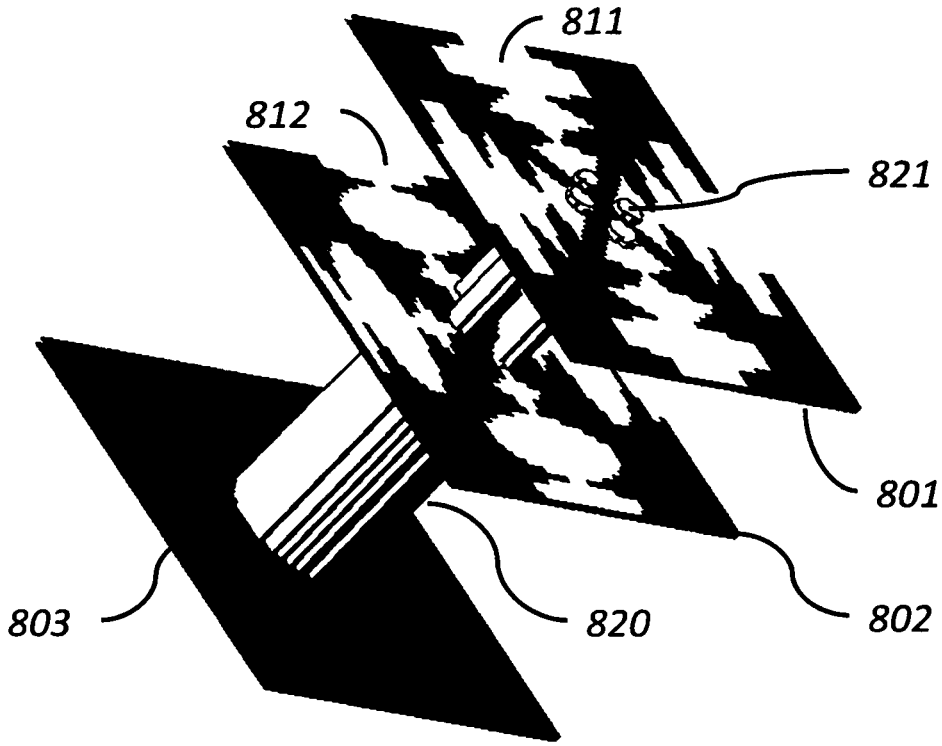
FIG. 8A shows a related "Two Layer Complimentary" UWB Array Element Unit Cell with an active fed middle layer.

FIG. 8A shows a final alternate embodiment of an array unit cell wherein an AMC-like PCB layer 802 (nominally 60 mil thick Rogers 4003 again) with computer generated and optimized metallic patches 812 is disposed between a top level active dual polarized antenna element PCB 801 (nominally 60 mil thick Rogers 4003 again) with metallic patches 811 and a PEC backplane 803. The total thickness is two inches and the second PCB layer 802 is displaced 0.75 inches back from the top plane 801. A four conductor coax 820 with outer cylindrical metallic ground sheath underlies PCB 802, exposing its four conductors 821 that then feed the metallic patches on both the 802 and the 801 layers. The metallic patches are again comprised of UWB antenna element shapes as earlier described, and the unit cells are permitted to connect conductively with neighboring unit cells along the patch borders near 811 and 812 and the corresponding other three sides of the symmetric unit cell. A feature of the patches is the use of complementary UWB shapes such as Bowties on one layer 801 and ellipses on the other layer 802.

Figure 8B:
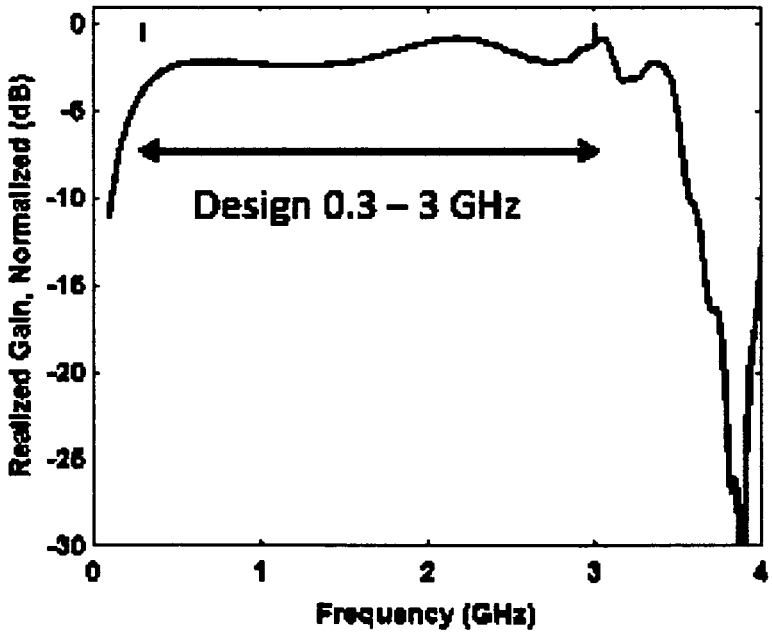
FIG. 8B shows the Realized Gain performance of the "Two Layer Complimentary" UWB Connected Array.

FIG. 8B shows the performance of this design. The unit cell design exhibits over decade bandwidth with decent performance throughout. This design is not fully optimized and further computer time would yield better performance still with computer modified metal patches and layer offset distances. Additionally, a further degree of freedom is to change the feed fraction going to the middle layer 802 from the feed lines 821. Additional layers, either passive and/or active serve to add more ADM and offer potential bandwidth expansion under computer optimization.

Having thus described my invention and the manner of its use, it should be apparent to those skilled in the relevant arts that incidental changes may be made thereto that fairly fall within the scope of the following appended claims, wherein I claim:

REFERENCES

1. *Metamaterials*, Nader Engheta, Richard W. Ziolkowski. Wiley Interscience, 2006.
2. Sievenpiper, D., "High-Impedance Electromagnetic Surfaces", Ph. D. Dissertation, Dept. of Electrical Engineering, University of California, Los Angeles, Calif., 1999.
3. Sievenpiper, D. and Eli Yablonovitch, "Eliminating Surface Currents with Metallodielectric Photonic Crystals", 1998 IEEE MTT-S International Microwave Symposium Digest, vol. 2, pp. 663-666, 7 Jun. 1998.
4. Sievenpiper, D. et al., "High-Impedance Electromagnetic Surfaces with a Forbidden Frequency Band", IEEE Transactions on Microwave Theory and Techniques, vol 47, No. 11, pp. 2059-2074, November 1999.
5. U.S. Pat. No. 6,483,480, U.S. Pat. No. 6,545,647, U.S. Pat. No. 6,952,190, U.S. Pat. No. 6,952,184, U.S. Pat. No. 6,433,756, App 20090002240, App 20040227667, App 20070211403, App 20040084207.
6. *The Art and Science of UWB Antennas*, Hans G. Schantz, Artech House, Norwood, Mass., 2005, pgs 258-261.
7. *The Art and Science of UWB Antennas*, Hans G. Schantz, Artech House, Norwood, Mass., 2005.
8. Antenna Theory And Design, R. S. Elliot, Chapter 10.15, IEEE Press, 2003.
9. M. P. Kesler, J. G. Maloney, B. L. Shirley, "*Antenna Design With The Use Of Photonic Band-Gap Materials As All-Dielectric Planar Reflectors*", Microwave and Optical Technology Letters, Vol. 11, No. 4 Mar. 1996.

The invention claimed is:

1. An artificial magnetic conductor "AMC", comprising:

a bottom at least partially conductive ground plane for reflecting incident electromagnetic radiation from said ground plane, and blocking electrodynamic radiation from flowing past the AMC on the ground plane side of the AMC, a middle layer above the conductive ground plane and comprising one or more layers of one or more materials with electrical properties wherein said middle layer and the electrical properties thereof establishes a phase difference or time delay between said incident electromagnetic radiation and said reflected electromagnetic radiation from the said ground plane;

a top layer comprising a plurality of first unit cells arranged in an array wherein each first unit cell of the plurality of first unit cells includes at least one wide-band dipole antenna wherein the wide-band dipole antenna further includes at least partially conductive elements; and wherein the feed points of each said wide-band dipole antenna are left open, whereby the conductive ground plane, the middle layer and the top layer collectively have a high impedance that passively reflects incident in-band electromagnetic energy over a very wide-band width a substantially in the polarization plane of the very wide band dipole antenna with a reflection phase of approximately zero degrees across the bandwidth.

2. The AMC of claim 1 further comprising a supersaturate layer above said top layer, providing physical and/or environmental protection to said AMC top layer and said middle layer and further providing additional electrical properties to promote AMC performance.

3. The middle layer of claim 1 wherein the one or more materials are selected from a plurality of materials having properties of permeability, loss tangent, and dielectric for use in the AMC.

4. The AMC of claim 1 whereby said very wide-band width is an Ultra-Wide Bandwidth defined as factional bandwidth greater than 25%.

5. The AMC of claim 1 whereby said reflection phase of approximately zero degrees is defined over the phase band of −90 degrees to +90 degrees.

6. The one or more materials of the middle layer of claim 1 and any supersaturate are one or more of the following materials: vacuum, air, foam, dielectric, artificial dielectric, magnetics, paramagnetics, ferrite, artificial magnetics, resistive material, absorber, metamaterial, and Printed Circuit Board (PCB) substrate.

7. The at least one wide-band dipole antenna of claim 1 wherein an element shape comprising said antenna can be one or more of the following: Bowties, Triangles, ellipses, teardrops, "Bunny Ears", circles, ellipses, V-shapes, spirals, complimentary antenna elements, tapered slots, Vivaldi-like slots, TEM horn shapes, a three-dimensional shape, a three dimensional bulbus shapes, ovoids, or any UWB dipole antenna shape for providing a UWB antenna response.

8. The at least one wide-band dipole antenna of claim 1 wherein the at least partially conductive elements are not electrically coupled to each other within each said first unit cell.

9. The at least one wide-band dipole antenna of claim 1 wherein the at least partially conductive elements are conductively coupled to each other within each said first unit cell.

10. The at least one wide-band dipole antenna of claim 1 wherein the at least partially conductive elements are resistively coupled to each other within each said first unit cell.

11. The at least one wide-band dipole antenna of claim 1 wherein the at least partially conductive elements are reactively coupled to each other within each said first unit cell.

12. The at least one wide-band dipole antenna of claim 1 wherein the at least partially conductive elements within a given first unit cell are not electrically coupled to said at least partially conductive elements within adjacent said first unit cells.

13. The at least one wide-band dipole antenna of claim 1 wherein the at least partially conductive elements within a given said first unit cell are conductively coupled to like said at least partially conductive elements within adjacent said first unit cells.

14. The at least one wide-band dipole antenna of claim 1 wherein the at least partially conductive elements within a given said first unit cell are restively coupled to like said at least partially conductive elements within adjacent said first unit cells.

15. The at least one wide-band dipole antenna of claim 1 wherein the at least partially conductive elements within a given said first unit cell are reactively coupled to said at least partially conductive elements within adjacent said first unit cells.

16. The AMC of claim 1 wherein said first unit cells are exactly the same size.

17. The AMC of claim 1 wherein the plurality of said first unit cells are approximately the same size.

18. The AMC of claim 1 wherein the plurality of first unit cells progressively vary in size as a function of position across the AMC.

19. The plurality of first unit cells of claim 1 wherein each said first unit cell further comprises two or more at least partially, and preferably orthogonally crossed wide-band dipole antennas, said orthogonally crossed wide-band dipole antennas being in a plane of the AMC, and referred to as a wide-band dual polarized dipole antenna for providing a dual or mulit-polarized electromagnetic response, wherein said wide-band dual polarized dipole antenna further includes include at least partially conductive elements; and, wherein a plurality of multi-polarized feed points of each said wide-band dual polarized dipole antenna are left open, whereby the conductive ground plane, the middle layer and the top layer collectively have a high dual polarized impedance that passively reflects incident in-band electromagnetic energy over a very wide-band width substantially the polarization directions of said wide-band dipole antennas with a reflection phase of approximately zero degrees across the bandwidth in multi-polarizations.

20. The AMC of claim 19 wherein the at least partially conductive elements are modified, distended, punctured and contoured to produce a more favorable AMC response as determined through electromagnetic simulation.

21. The AMC of claim 19 wherein said feed points are optionally connected conductively or reactively to said ground plane wherein the feed points terminate longitudinal waves from off boresight incident radiation or off boresight radiative emission.

22. The first unit cell of claim 19 wherein a center of each of said at least partially conductive elements is disposed between the plurality of feed points of the said wide-band dipole antennas, wherein said plurality of multi-polarized feed points retract outward from the center of each said first unit cell to provide sufficient space for said center of each said at least partially conductive element of said at least partially conductive elements, the center of each of said at least partially conductive element are non-coupled, or coupled to said wide-band dipole antenna elements by mutual capacitance and/or inductance for providing a common neutral voltage reference for an desired open circuit feed response of the AMC.

23. The AMC of claim 22 where the plurality of multi-polarized feed points are conductively unconnected and are reactively connected to the center at least partially conductive element.

24. The AMC of claim 22 wherein the center at least partially conductive element is coupled conductively and/or reactively to the at least partially conductive ground plane wherein said coupling helps terminate longitudinal waves from off boresight incident radiation or off boresight radiative emission.

25. The AMC of claim 1 further comprising a plurality of layers substantially identical to or similar to said top layer, wherein the plurality of layers are disposed one on top of the other.

26. The AMC of claim 1 further comprising a plurality of layers substantially identical to or similar to said top layer, wherein the plurality of layers are disposed one on top of the other and positioned laterally at first unit cell offsets, or half first unit cell offsets, or fractional first unit cell offsets.

27. A physically thin and very light weight Artificial Dielectric Material, referred to as "ADM", comprising the top layer of claim 1, providing an artificially produced dielectric constant that operates over a very wide bandwidth.

28. An AMC comprising a ground plane and the ADM of claim 27 offset above the ground plane by an electrical path length defined by a physical offset and a ADM dielectric constant, said electrical path length equal to approximately one quarter wavelength referenced to a center frequency of an operating band in free space, said AMC providing UWB bandwidth performance.

29. An antenna apparatus for receiving and/or transmitting a radio frequency wave, said antenna apparatus comprising:

an electrically thin very wide-band AMC of claim 1, one or more wide-band or Ultra-Wideband (UWB) antennas of a single or dual polarity type, located above and in close proximity to said AMC, with one or a plurality of said feed points spaced apart by and contained within a second unit cell to excite or receive said single or dual polarity electromagnetic radiation, wherein said plurality of feed points are connected to a feed network sourcing or sinking said electromagnetic radiation, a feed network connected conductively or reactively to said one feed point or said plurality of feed points in order to provide radio frequency power to or receive radio frequency power from said antenna above said wideband AMC.

30. The antenna apparatus of claim 29 where said wide-band or UWB antenna is a singly or multi-polarized antenna selected from vertically polarized, horizontally polarized, slant polarized, dual orthogonally polarized, multi-partially polarized, circularly polarized, or elliptically polarized types.

31. The antenna apparatus of claim 29 where said wide-band or UWB antenna is an array antenna.

32. The array antenna of claim 31 comprising a grid of second unit cells wherein each second unit cell of said second unit cells further comprises one or more single or dual polarized wide band or UWB antenna elements, arranged substantially as one or more single or dual polarized wide-band dipole antennae.

33. The array antenna of claim 32 wherein said grid of said second unit cells is a non-uniform grid.

34. The array antenna of claim 33 wherein said non-uniform grid of said second unit cells is further characterized by a spacing between said second unit cells that gradually changes as a function of position across the array antenna.

35. The antenna apparatus of claim 29 where said one or more wide-band or UWB antennas are a connected array antenna.

36. The antenna apparatus of claim 29 wherein said one or more wide-band or UWB antennas are a Vivaldi slot connected array antenna.

37. The antenna apparatus of claim 29 wherein said one or more wide-band or UWB antennas is a fragmented aperture antenna.

38. The antenna apparatus of claim 29 wherein said one or more wide-band or Ultra-Wideband (UWB) antennas is further coupled conductively or reactively to adjacent said antennas within same or adjacent second unit cells.

39. An antenna apparatus for receiving and/or transmitting a radio frequency wave, said antenna apparatus comprising:

the antenna apparatus of claim 29, an additional one or plurality of said wide-band or Ultra-Wideband (UWB) antennas of claim 29, of same, similar or different detail design, with one or a plurality of feed points, said wide-band or Ultra-Wideband (UWB) antennas of claim 29 disposed interstitially between said bottom and top of said very wide-band AMC of claim 29 inside of their own third unit cells measuring the same size as and aligned above with the second unit cells, one or plurality of feed networks connected either conductively or reactively to said additional one or plurality of said wide-band or Ultra-Wideband (UWB) antennas, in order to share a portion of the radio frequency power with the said antenna apparatus of claim 29.

40. The antenna apparatus of claim 39 wherein said third unit cells are arranged in a uniform grid.

41. The grid of claim 39 wherein said third unit cells are arranged in a non-uniform grid.

42. The array antenna of claim 41 wherein said non-uniform grid is a grid of third unit cells further characterized by a spacing between said third unit cells that gradually changes as a function of position across the array antenna.

43. The third unit cells of claim 39 wherein said third unit cells are an integral multiple of the size of said second unit cells.

44. The third unit cells of claim 39 wherein said third unit cells are an integral divisor of the size of said second unit cells Second Unit Cells.

45. The third unit cells of claim 39 wherein said third unit cells are not aligned with the second unit cells.

46. The antenna apparatus of claim 39 wherein said one or a plurality of feed points are left open and unconnected to any feed network.

47. The antenna apparatus of claim 39 wherein said plurality of feed points disposed interstitially between said bottom and top of said very wide-band AMC are connected to one or a plurality of different feed networks other than employed for said wide-band or Ultra-Wideband (UWB) antennas, said one or a plurality of different feed networks providing separate amplitude, frequency, time and phase control of a transmitted or received signal.

48. The antenna apparatus of claim 39 wherein said plurality of feed points disposed interstitially between said bottom and top of said of said very wide-band AMC are connected to the same feed network employed for the said wide-band or Ultra-Wideband (UWB) antennas.

49. The antenna apparatus of claim 48 wherein said plurality of feed points disposed interstitially between said bottom and top of said very wide-band AMC are displaced in distance from the feed points of the said wide-band or Ultra-Wideband (UWB) antennas towards the ground plane, said distance providing a phase or time shift to a feed transmit or received signal.

50. The antenna apparatus of claim 39 wherein said plurality of feed points disposed interstitially between said bottom and top of said very wide-band AMC are connected to a same feed network as employed in for said wide-band or Ultra-Wideband (UWB) antennas, but wherein the feed signal may be advanced or retarded in time, phase and modified in amplitude through the intervention of dedicated time delay units or phase shifters and/or attenuators and/or filters and/or amplifiers.

* * * * *